US012582184B2

(12) United States Patent
Horie

(10) Patent No.: US 12,582,184 B2
(45) Date of Patent: Mar. 24, 2026

(54) WIG BASE, WIG AND MANUFACTURING METHOD FOR WIG BASE

(71) Applicant: Terasu heart japan Co., Ltd, Osaka (JP)

(72) Inventor: Takayoshi Horie, Hyogo (JP)

(73) Assignee: Terasu heart japan Co., Ltd, Osaka (JP)

( * ) Notice: Subject to any disclaimer, the term of this patent is extended or adjusted under 35 U.S.C. 154(b) by 216 days.

(21) Appl. No.: 17/964,040

(22) Filed: Oct. 12, 2022

(65) Prior Publication Data

US 2023/0113021 A1 Apr. 13, 2023

(30) Foreign Application Priority Data

Oct. 13, 2021 (JP) ..... 2021-168409

(51) Int. Cl.
*A41G 3/00* (2006.01)

(52) U.S. Cl.
CPC ..... *A41G 3/0041* (2013.01)

(58) Field of Classification Search
CPC ..... A41G 3/00; A41G 3/0025; A41G 3/005; A41G 3/0058; A41G 3/0041; A41G 3/0066; A41G 3/0075; A41G 3/0083; A41G 5/00; A41G 5/0013; A41G 5/0033; A41G 5/0006; A41G 5/004; A41G 5/0046;

(Continued)

(56) References Cited

U.S. PATENT DOCUMENTS 3,077,891 A * 2/1963 Lane ..... A41G 5/0006 132/201
3,225,489 A * 12/1965 Ryan ..... A63H 3/44 446/394

(Continued)

FOREIGN PATENT DOCUMENTS

JP H0290618 U 7/1990
JP H05295605 A 11/1993

(Continued)

OTHER PUBLICATIONS

Office Action issued for counterpart Japanese Application No. 2021-168409, issued by the Japanese Patent Office on Jan. 25, 2022 (drafted on Jan. 19, 2022).

(Continued)

*Primary Examiner* — Rachel R Steitz
*Assistant Examiner* — Karim Asqiriba

(57) ABSTRACT

A wig base is provided including a skin side layer of natural fiber, an outer layer of synthetic fiber for maintaining the shape, and adhesive for bonding the skin side layer and the outer layer together. The outer layer may be transparent fabric. The skin side layer may also be transparent fabric and the outer layer may have higher transparency than the skin side layer. The adhesive may not permeate into the skin side surface of the skin side layer. The skin side layer may be colored deep blue and pale red in comparison to the outer layer. A wig may be provided whose wig base is molded into a head shape and has hairs attached thereto. A manufacturing method for a wig base may be provided including a step of molding the wig base with a mold resembling a head through heating.

20 Claims, 7 Drawing Sheets

(58) Field of Classification Search
CPC .... A41G 5/0053; A41G 5/0066; A41G 5/008; A41G 5/0093
See application file for complete search history.

(56) References Cited

U.S. PATENT DOCUMENTS

| | | | | |
|---|---|---|---|---|
| 3,710,452 | A * | 1/1973 | Hamrick | A41G 3/00 34/95 |
| 5,085,233 | A | 2/1992 | Motoori | |
| 2009/0235943 | A1* | 9/2009 | Sugai | A41G 3/0041 132/54 |
| 2009/0241973 | A1* | 10/2009 | Hampton | A41G 3/0025 132/54 |
| 2010/0326455 | A1* | 12/2010 | Karsenti | A41G 3/0008 132/53 |
| 2014/0299145 | A1* | 10/2014 | Chira | A41G 3/005 132/53 |
| 2016/0081411 | A1* | 3/2016 | Shin | A41G 3/0041 132/201 |
| 2016/0113342 | A1* | 4/2016 | Park | A41G 3/0033 132/54 |
| 2017/0215506 | A1* | 8/2017 | Sim | A41G 3/0066 |
| 2022/0125143 | A1* | 4/2022 | Reid | A41G 3/0033 |

FOREIGN PATENT DOCUMENTS

| | | | |
|---|---|---|---|
| JP | 2000226704 | A | 8/2000 |
| JP | 2007321282 | A | 12/2007 |
| JP | 2016138357 | A | 8/2016 |
| JP | 2017172087 | A | 9/2017 |
| JP | 2018159168 | A | 10/2018 |
| JP | 2019189963 | A | 10/2019 |

OTHER PUBLICATIONS

Office Action issued for counterpart Chinese Application 202211247168.3, issued by The State Intellectual Property Office of People's Republic of China on Jul. 12, 2025.

* cited by examiner

WIG BASE, WIG AND MANUFACTURING METHOD FOR WIG BASE

The contents of the following Japanese patent application are incorporated herein by reference: JP2021-168409 filed in Japan on Oct. 13, 2021

BACKGROUND

1. Technical Field

The present invention relates to a wig base, a wig, and a manufacturing method for a wig base.

2. Related Art

Patent document 1 describes that a wig worn on a head consists of a wig base that is molded into a head shape and is used as a foundation, and human hairs or artificial hairs attached to the wig base, and that commonly used material of the wig base includes, for example, non-porous thermoplastic resin membrane such as urethane elastomer that is referred to as artificial skin and a net consisting of mesh-like woven or knitted fabric made from synthetic fiber and the like.

PRIOR ART DOCUMENT

Patent Document

Patent document 1 Japanese Unexamined Patent Application, Publication No. 2007-321282

DESCRIPTION OF EXEMPLARY EMBODIMENTS

Hereinafter, (some) embodiment(s) of the present invention will be described. The embodiment(s) do(es) not limit the invention according to the claims. In addition, not all of the combinations of features described in the embodiments are essential to the solution of the invention.

Figure 1:
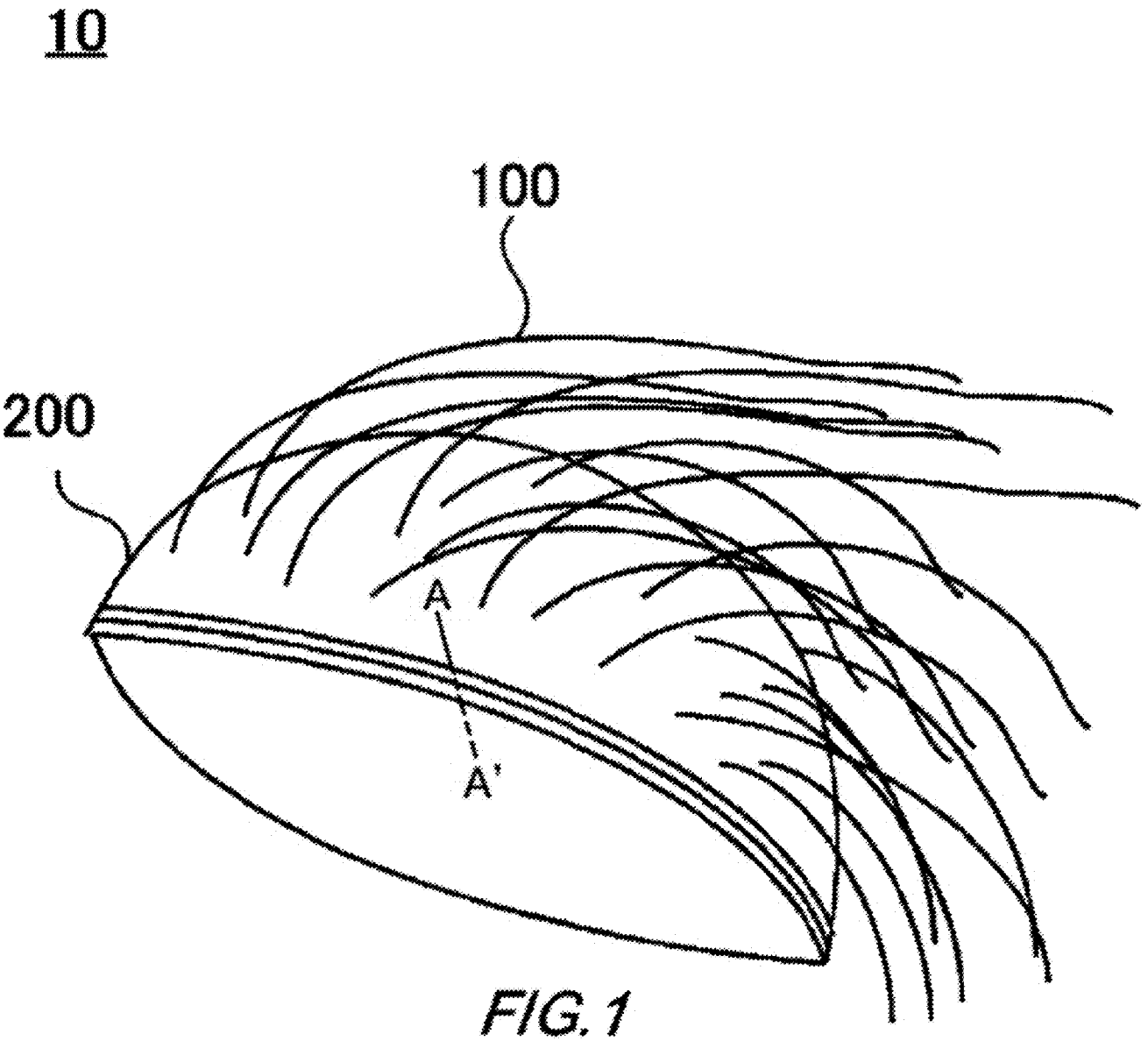
FIG. 1 is a schematic diagram illustrating an entire wig 10.

FIG. 1 is a schematic diagram illustrating an entire wig 10. The wig 10 is worn on a head of a user and fully or partially covers the head.

The wig 10 includes a mold base 200 and multiple hairs 100 attached to the mold base 200. The hairs 100 are artificial hairs and/or natural hairs.

In this embodiment, the mold base 200 maintains the bowl shape of the wig 10 that is convex toward the side of the hairs 100. Said shape is molded according to the shape of the head of each user and such wig 10 is called a custom made wig. Since the custom made wig is required to maintain its shape according to the head by itself, it is contemplated that the mold base 200 is made from synthetic fiber. However, the mold base 200 made from synthetic fiber cannot be used for a user having sensitive skin, who experiences itching or the like when the synthetic fiber touches the skin.

Figure 2:
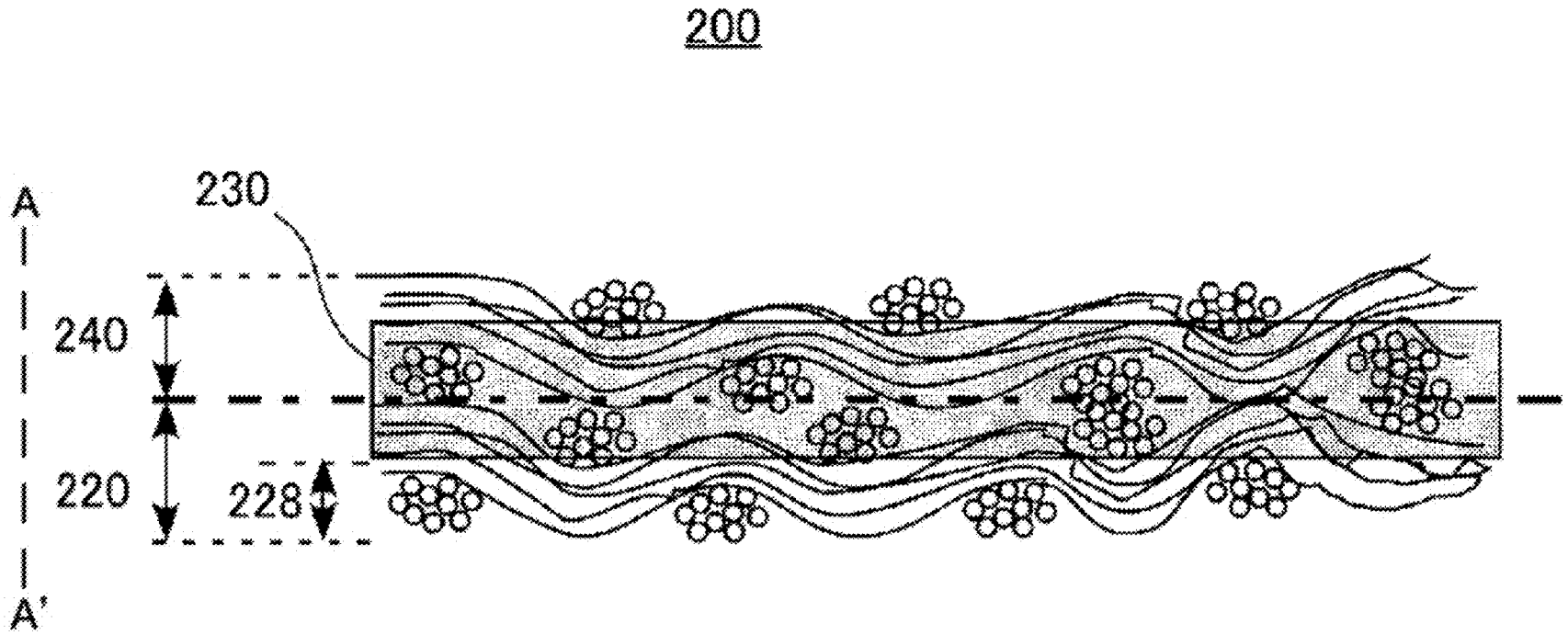
FIG. 2 is an enlarged partial cross-sectional view of a mold base 200 taken along A-A' in FIG. 1.

FIG. 2 is an enlarged partial cross-sectional view of a mold base 200 taken along A-A' in FIG. 1. The mold base 200 includes a skin side layer 220 located on the side of the head, i.e. the side of the skin, of the user, an outer layer 240 that is on the opposite side to the skin, adhesive 230 that bonds the skin side layer 220 and the outer layer 240 together. On the skin side surface of the skin side layer 220 (the bottom surface in FIG. 2), a non-adhesive layer 228, into which the adhesive 230 is not permeated, is formed. In this way, the scalp of a user is in contact with natural fiber and the scalp is not in contact with adhesive and synthetic fiber, thus providing a comfortable use experience for a user with sensitive skin.

Figure 3:
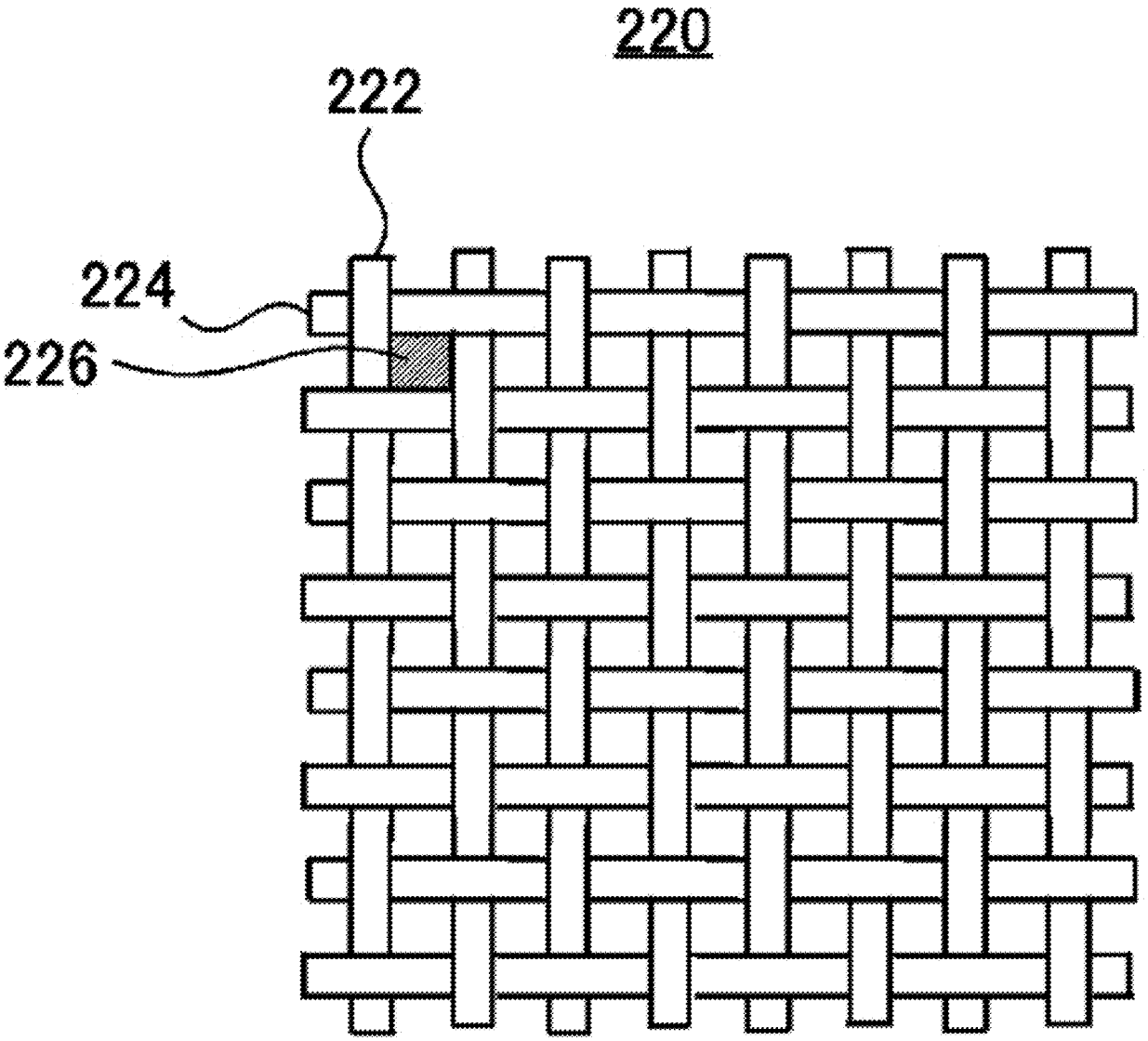
FIG. 3 is a schematic view illustrating a skin side layer 220.

FIG. 3 is a schematic view illustrating the skin side layer 220. The skin side layer 220 is textile of natural fiber. The natural fiber is plant fiber and/or animal fiber, for example, cotton, hemp, silk, wool, and the like. Note that the plant fiber is preferably so-called organic product, which is organically grown.

The skin side layer 220 shown in FIG. 3 is made through plain weaving involving a warp yarn 222 and a weft yarn 224 and is transparent fabric having a gap 226 that provides transparency that can be recognized through visual observation. Examples of such transparent fabric includes organdy. Other examples of the transparent fabric includes leno weave such as ro, sha, and the like. The skin side layer 220 preferably has a small thickness, for example, 0.12 mm or less. The skin side layer 220 is dyed in skin color with reactive dye.

Figure 4:
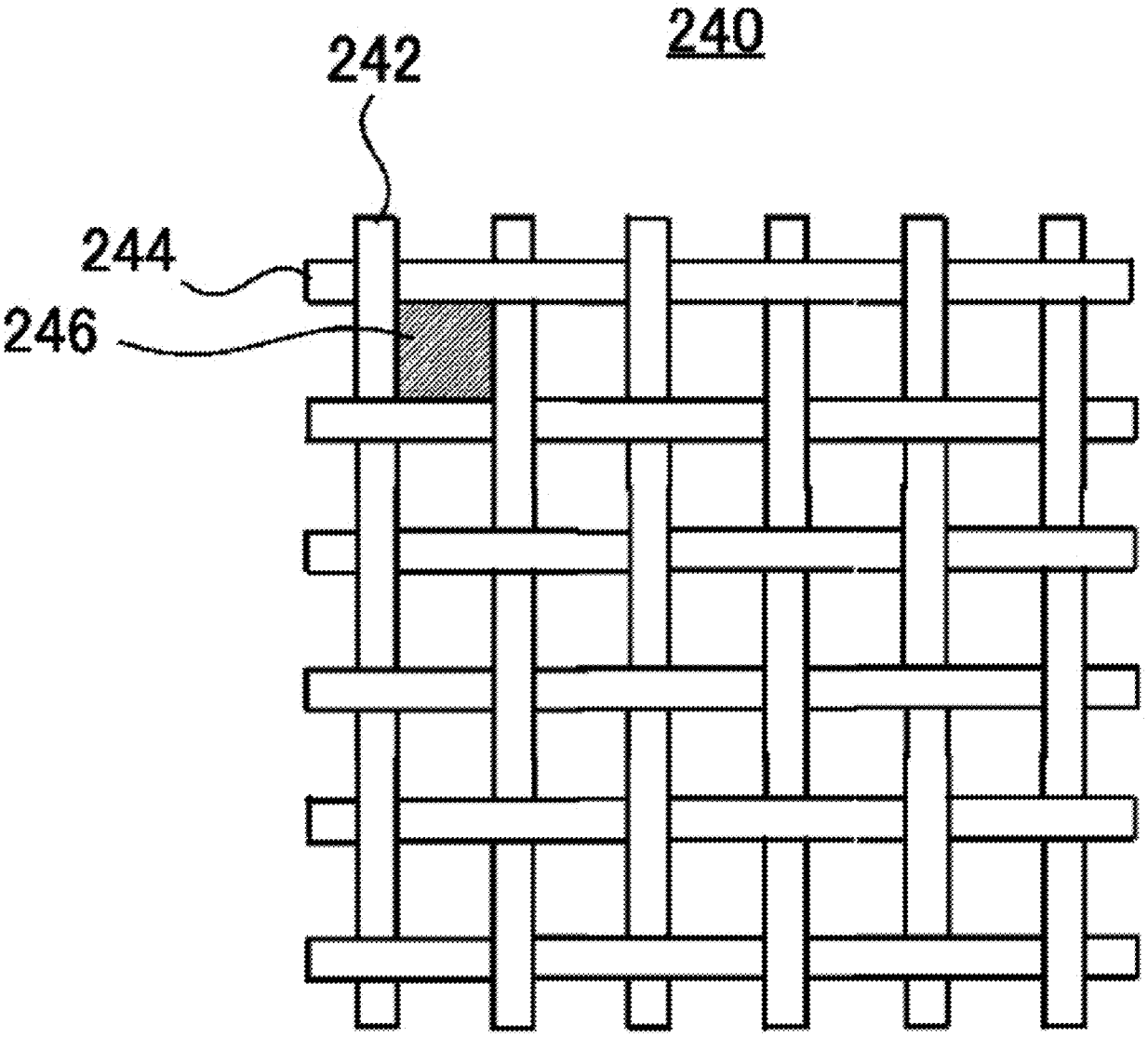
FIG. 4 is a schematic view illustrating an outer layer 240.

FIG. 4 is a schematic view illustrating the outer layer 240. The outer layer 240 is textile of synthetic fiber. Examples of synthetic fiber include polyester, nylon, acrylic, polyurethane, and the like. The synthetic fiber, whose shape is molded through heat molding, preferably maintains its molded shape by itself. In other words, the synthetic fiber enables the outer layer 240 to maintain its molded shape as the mold base 200 even when the outer layer 240 sticks to the skin side layer 220.

The outer layer 240 shown in FIG. 4 is made through plain weaving involving a warp yarn 242 and a weft yarn 244 and is transparent fabric having a gap 246 that provides transparency that can be recognized through visual observation. Examples of such transparent fabric includes organdy. The outer layer 240 also preferably has small thickness, for example, 0.12 mm or less. Other examples of the transparent fabric includes leno weave such as ro, sha, and the like. The outer layer 240 is dyed as skin color with disperse dye.

When the skin side layer 220 and the outer layer 240 are compared, the outer layer 240 preferably has higher transparency. The level of transparency corresponds to, for example, the average size of the gap, and the area of the gap 246 is greater than that of the gap 226. In addition, the level of transparency may be compared based on the degree of area occupied by yarn per unit area in the plane view.

Furthermore, when the skin side layer 220 and the outer layer 240 are compared, the skin side layer 220 is preferably colored deep blue and/or pale red in comparison to the outer layer 240. In this way, when viewed from the side of the outer layer 240, the skin side layer 220 is partially visible through the gap 246 of the outer layer 240, which makes skin color look deep, more natural, and similar to scalp as a whole. Note that, in this viewpoint, the skin side layer 220 may not be transparent fabric. In addition, the skin side layer 220 and/or outer layer 240 may be knitted fabric as long as it can be molded.

Figure 5:
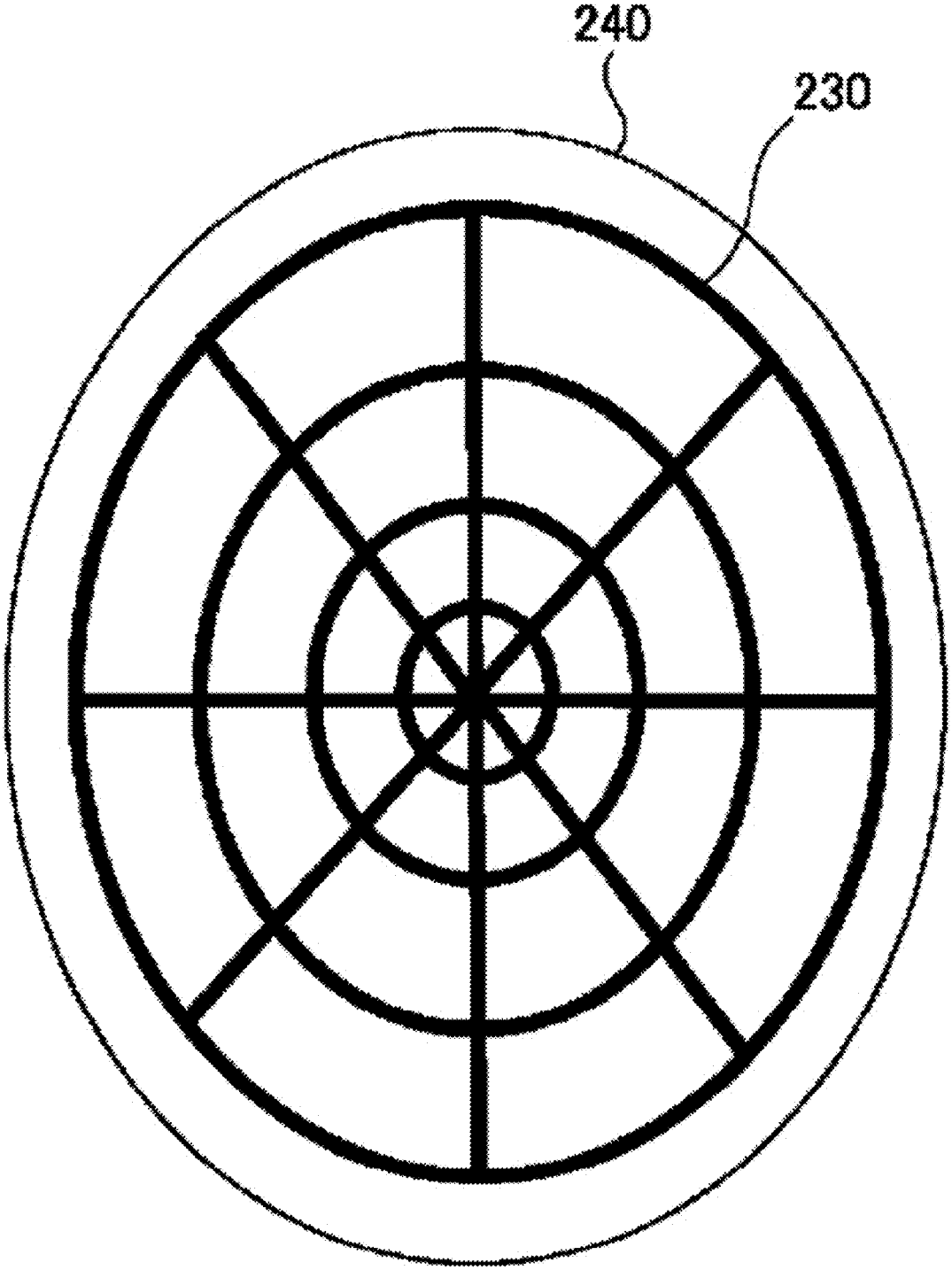
FIG. 5 is an example of a method for applying adhesive 230.
Figure 7:
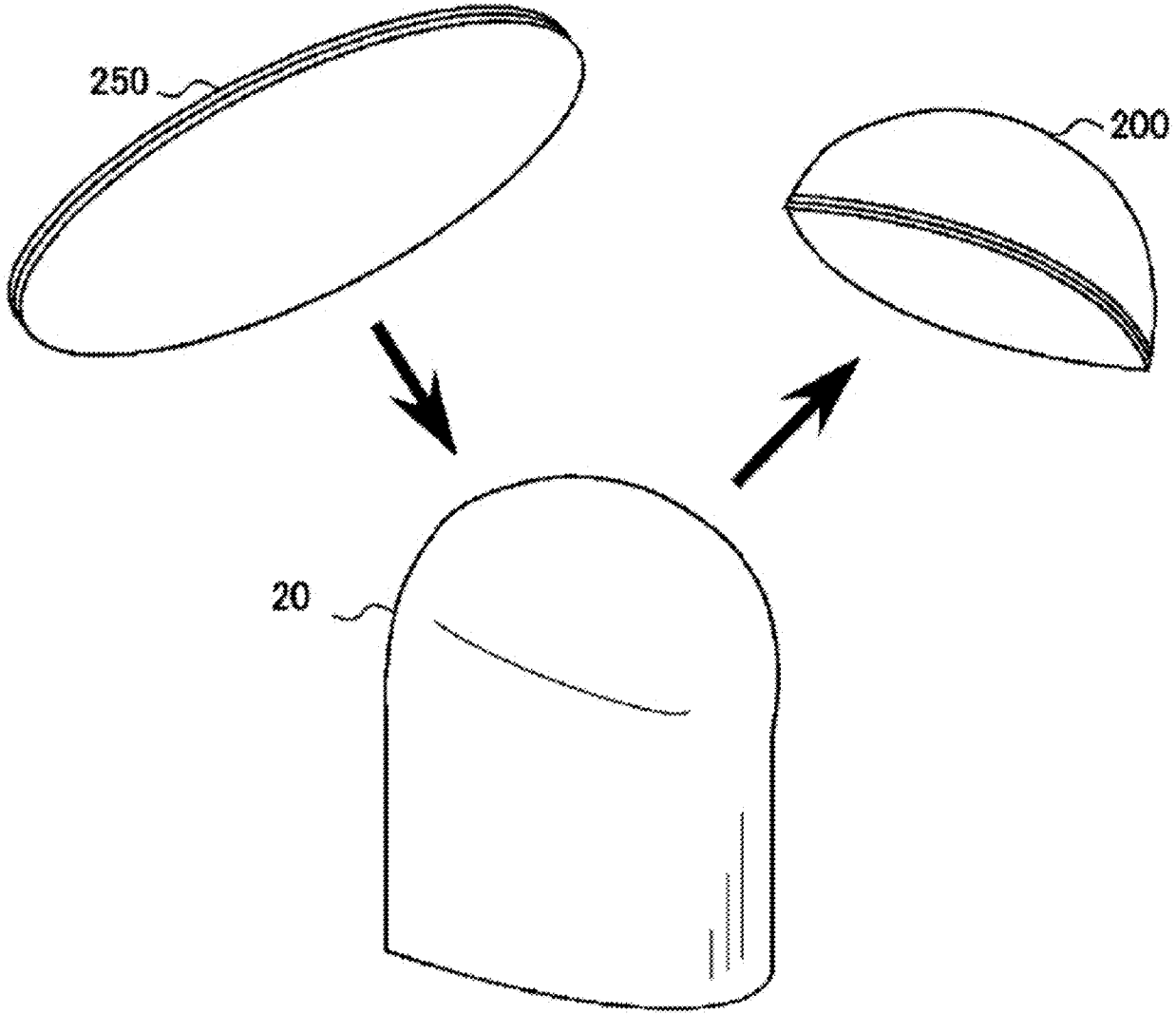
FIG. 7 is an example of a method for molding a mold base 200.

FIG. 5 and FIG. 7 are schematic diagrams illustrating a manufacturing method for the mold base 200. FIG. 5 is an example of a method for applying an adhesive 230.

The fabric of outer layer 240 shown in FIG. 4 is prepared and cut into an approximately elliptical shape in accordance with the area covering a head. On one surface of the outer layer 240, the adhesive 230 is applied in a so-called spider web pattern consisting of line segments radiating from the center and the concentric elliptical lines. The adhesive may be applied uniformly or in a mesh-like pattern, instead of the spider web pattern. In both cases, preferable application method and application amount are those that cause a non-adhesive layer 228 to be formed on the skin side when the outer layer 240 sticks to the skin side layer 220, while maintaining sufficient strength to prevent separation during its use. Examples of the adhesive 230 may include polyamide resin and polyurethane resin.

Figure 6:
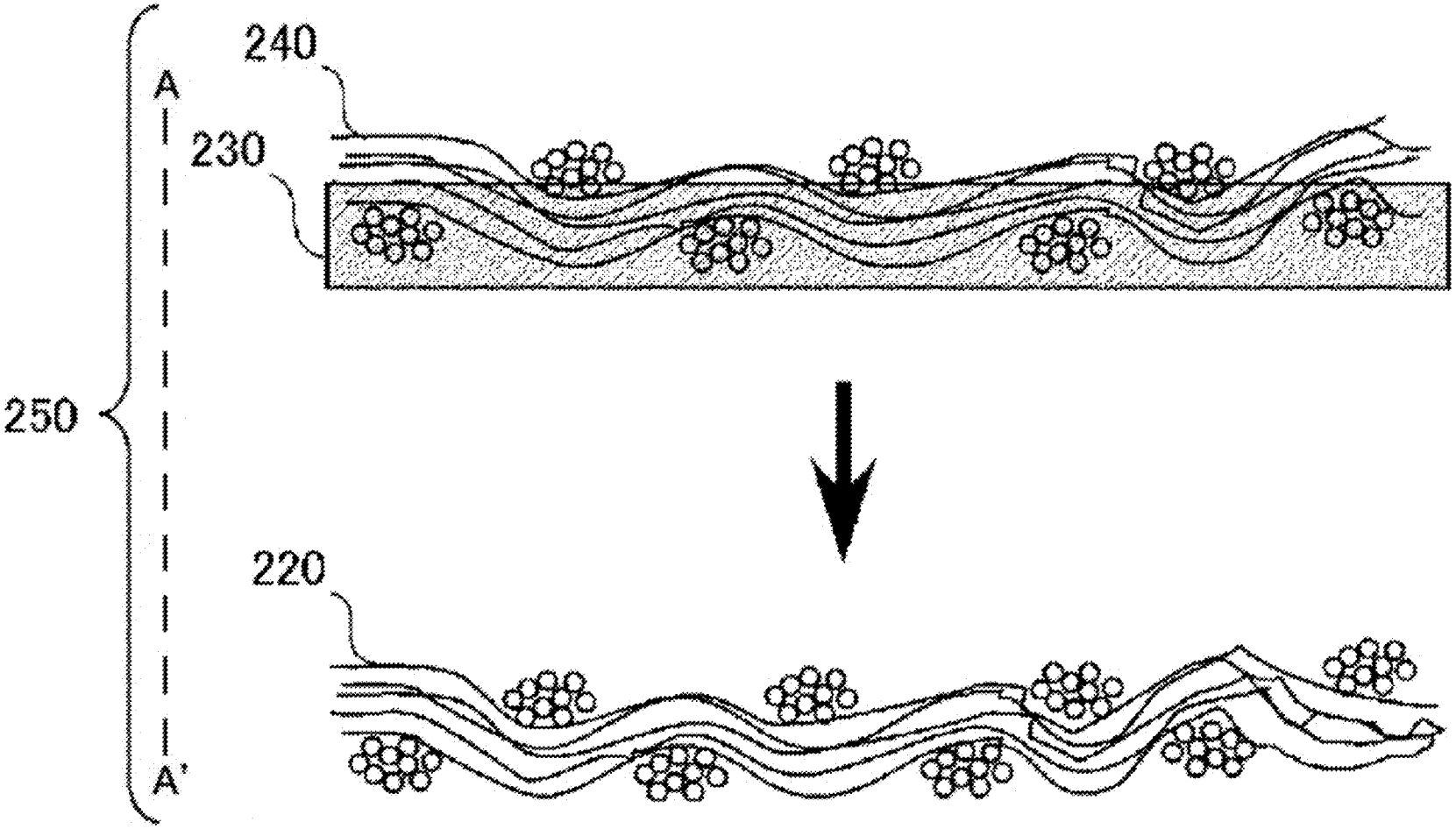
FIG. 6 is a partial cross-sectional view of an example of a method for sticking an outer layer 240 and a skin side layer 220 together, taken along A-A' in FIG. 1.

FIG. 6 is a partial cross-sectional view of an example of a method for sticking the outer layer 240 and the skin side layer 220 together, taken along A-A' in FIG. 1. The surface on the side of the adhesive 230 of the outer layer 240, to which the adhesive 230 is applied, is laid over the skin side layer 220 shown in FIG. 3, and then heated and pressurized. This method is called hot melt. In this way, the base fabric 250 including layered structure of the outer layer 240 and skin side layer 220 is formed.

FIG. 7 is an example of a method for molding a mold base 200. In FIG. 7, the mold 20 resembling the shape of the head of a user is prepared. In this case, a cast may be taken from the head of the user, using vinyl, wrap film, a 3D scanner, or the like.

The base fabric 250 is pressurized and heated using, for example, a soldering iron and the like, while it is in accordance with the mold 20. In this way, the mold base 200, which is molded according to the mold 20, is formed. The hair 100 is attached to the mold base 200 to create the wig 10 shown in FIG. 1.

EXAMPLE 1

The skin side layer 220 is made from the fabric with a thickness of 0.12 mm made by weaving 140 single yarn cotton into organdy and is dyed as beige. The outer layer 240 is made from the fabric with a thickness of 0.12 mm made by weaving 20 denier nylon into organdy, and is dyed as pale skin color.

The adhesive 230 of polyamide resin is applied in a spider web pattern on one surface of the outer layer 240, which is then hot melted with the skin side layer 220. In this way, the base fabric 250 is obtained in which the non-adhesive layer 228 is formed on the skin side layer 220 and which has sufficient strength preventing separation during its use.

The base fabric 250 is heated to about 100 degree with the mold 20 to obtain the mold base 200 that maintains its shape in accordance with the head by itself. In this way, the custom made wig 10 can be provided that can be comfortably used by a user with sensitive skin.

While the embodiments of the present invention have been described, the technical scope of the present invention is not limited to the above-described embodiments. It is apparent to persons skilled in the art that various alterations or improvements can be made to the above-described embodiments. It is also apparent from the description of the claims that the embodiments to which such alterations or improvements are made can be included in the technical scope of the present invention.

The operations, procedures, steps, and stages of each process performed by an apparatus, system, program, and method shown in the claims, specification, or drawings can be performed in any order as long as the order is not indicated by "prior to," "before," or the like and as long as the output from a previous process is not used in a later process. Even if the process flow is described using phrases such as "first" or "next" in the claims, specification, or drawings, it does not necessarily mean that the process must be performed in this order.

What is claimed is:

1. A wig base comprising:

a skin side layer of natural fiber;

an outer layer of synthetic fiber that maintains by itself a molded shape of the wig base; and adhesive that bonds an outside surface of the skin side layer to a surface of the outer layer that faces the outside surface of the skin side layer, wherein the adhesive is disposed in a pattern formed with line segments radiating from a center of the surface of the outer layer and concentric lines or in a mesh pattern, the skin side layer and the outer layer are colored with skin color, and the skin color of the skin side layer is more deep blue and more pale red in comparison to the skin color of the outer layer.

2. The wig base according to claim 1, wherein the outer layer is transparent fabric.

3. The wig base according to claim 2, wherein the skin side layer is also transparent fabric and the outer layer is more transparent than the skin side layer.

4. A wig comprising the wig base according to claim 3, wherein the wig base is molded into a head shape, and hairs are attached to the wig base.

5. A wig comprising the wig base according to claim 2, wherein the wig base is molded into a head shape, and hairs are attached to the wig base.

6. The wig base according to claim 1, wherein the adhesive is not permeated into a skin side surface of the skin side layer in contact with a user's head.

7. A wig comprising the wig base according to claim 6, wherein the wig base is molded into a head shape, and hairs are attached to the wig base.

8. A wig comprising the wig base according to claim 1, wherein the wig base is molded into a head shape, and hairs are attached to the wig base.

9. A manufacturing method for a wig base, comprising molding, through heating, the wig base according to claim 1, wherein the molded shape is configured to resemble a user's head.

10. A manufacturing method for a wig base, comprising molding, through heating, the wig base according to claim 2, wherein the molded shape is configured to resemble a user's head.

11. A manufacturing method for a wig base, comprising molding, through heating, the wig base according to claim 3, wherein the molded shape is configured to resemble a user's head.

12. A manufacturing method for a wig base, comprising molding, through heating, the wig base according to claim 6, wherein the molded shape is configured to resemble a user's head.

13. A wig base comprising:

a skin side layer of natural fiber;

an outer layer of synthetic fiber that maintains a shape; and adhesive that is made of a hot melt resin and bonds an outside surface of the skin side layer to a surface of the outer layer that faces the outside surface of the skin side layer, wherein the adhesive is disposed in a pattern formed with line segments radiating from a center of the surface of the outer layer and concentric lines or in a mesh pattern, the skin side layer and the outer layer are colored with skin color, and the skin color of the skin side layer is more deep blue and more pale red in comparison to the skin color of the outer layer.

14. The wig base according to claim 13, wherein the outer layer is transparent fabric.

15. The wig base according to claim 14, wherein the skin side layer is also transparent fabric and the outer layer is more transparent than the skin side layer.

16. The wig base according to claim 13, wherein the adhesive is not permeated into a skin side surface of the skin side layer in contact with a user's head.

17. A wig base comprising:

a skin side layer of natural fiber;

an outer layer of synthetic fiber that maintains a shape; and adhesive that bonds an outside surface of the skin side layer to a surface of the outer layer that faces the outside surface of the skin side layer, wherein the adhesive is disposed in a pattern formed with line segments radiating from a center of the surface of the outer layer and concentric lines or in a mesh pattern, the skin side layer and the outer layer are colored with skin color, and the skin color of the skin side layer is more deep blue and more pale red in comparison to the skin color of the outer layer.

18. The wig base according to claim 17, wherein the outer layer is transparent fabric.

19. The wig base according to claim 18, wherein the skin side layer is also transparent fabric and the outer layer is more transparent than the skin side layer.

20. The wig base according to claim 17, wherein the adhesive is not permeated into a skin side surface of the skin side layer in contact with a user's head.

* * * * *